United States Patent [19]

Weiler

[11] 4,084,566

[45] Apr. 18, 1978

[54] ELECTRONIC BREAKER POINTS FOR THE IGNITION SYSTEM OF A GASOLINE ENGINE

[76] Inventor: Kurt W. Weiler, P.O. Box 26018, Tempe, Ariz. 85282

[21] Appl. No.: 588,511

[22] Filed: Jun. 19, 1975

[51] Int. Cl.[2] ..... F02P 1/00; F02P 5/04

[52] U.S. Cl. ..... 123/148 E; 250/233; 123/148 F

[58] Field of Search ..... 123/148 E, 146.5 A, 123/148 CB, 148 F, 32 EA; 250/233; 315/209 T

[56] References Cited

U.S. PATENT DOCUMENTS

| | | | |
|---|---|---|---|
| 3,807,378 | 4/1974 | Wernet | 123/148 E |
| 3,810,448 | 5/1974 | Ford | 123/148 E |
| 3,839,659 | 10/1974 | Bruijning | 123/148 E |
| 3,861,369 | 1/1975 | Canup | 123/148 E |
| 3,861,370 | 1/1975 | Howard | 123/148 E |
| 3,868,938 | 3/1975 | Trass | 123/148 E |
| 3,888,220 | 6/1975 | Bigalke | 123/148 E |
| 3,913,550 | 10/1975 | Canup | 123/148 E |

*Primary Examiner*—Ronald B. Cox

[57] ABSTRACT

Electronic breaker points for the ignition system of a gasoline engine employs an optical circuit, chopping wheel, and pulse shaping circuit to replace the mechanical breaker points normally used in the ignition system of a gasoline engine. The output is of the proper form to control a transistor or thyristor ignition system.

6 Claims, 6 Drawing Figures

| | | | |
|---|---|---|---|
| $C_1$ = 1000 μf | $R_1$ = 470 Ohm | $T_1$ = 2N 1711 | $Z_1$ = 5.6 V |
| $C_2$ = 68 nf | $R_2$ = 85 Ohm | $T_2$ = 2N 1711 | $Z_2$ = 5.6 V |
| $C_3$ = 1000 μf | $R_3$ = 470 Ohm | $T_3$ = 2N 1711 | $Z_3$ = 47 V |
| $C_4$ = 68 nf | $R_4$ = 330 Ohm | | |
| $C_5$ = 10 nf | | | |
| $C_6$ = 330 nf | | | |
| $IC_1$ = SN 7413 | | | |

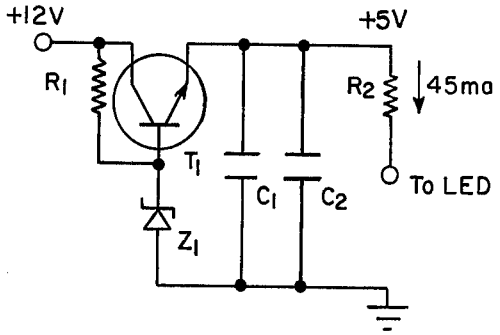
FIG. 3A
FIG. 3B
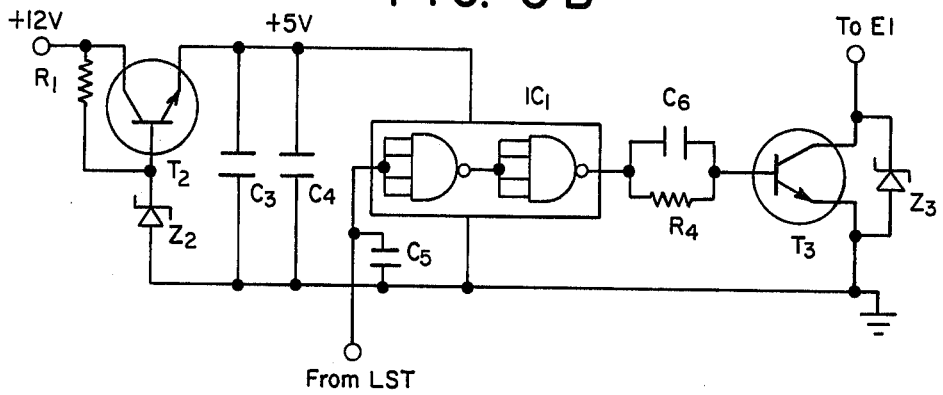
FIG. 3 C
| | | | |
|---|---|---|---|
| $C_1$ = 1000 μf | $R_1$ = 470 Ohm | $T_1$ = 2N 1711 | $Z_1$ = 5.6 V |
| $C_2$ = 68 nf | $R_2$ = 85 Ohm | $T_2$ = 2N 1711 | $Z_2$ = 5.6 V |
| $C_3$ = 1000 μf | $R_3$ = 470 Ohm | $T_3$ = 2N 1711 | $Z_3$ = 47 V |
| $C_4$ = 68 nf | $R_4$ = 330 Ohm | | |
| $C_5$ = 10 nf | | | |
| $C_6$ = 330 nf | | | |
| $IC_1$ = SN 7413 | | | |

ELECTRONIC BREAKER POINTS FOR THE IGNITION SYSTEM OF A GASOLINE ENGINE

SUMMARY

Electronic breaker points for the ignition system of a gasoline engine, hereafter referred to as the "device", consists of an optical circuit formed by a Light Emitting Diode (LED) and Light Sensitive Transistor (LST) mounted with an air gap between them in the distributor of a gasoline engine; a chopping wheel, whick has the proper teeth and gaps to make and break the optical circuit at the times and for the durations necessary to achieve the correct timing and dwell, rotated through this air gap by the shaft of the distributor; and a pulse shaping circuit whose output has the capability of switching an Electronic Ignition (EI) system. The LED burns continuously and is powered by a conventional, simple power supply. The device described in the following sections has been successfully used on a gasoline powered engine.

DRAWINGS

Figure 1:
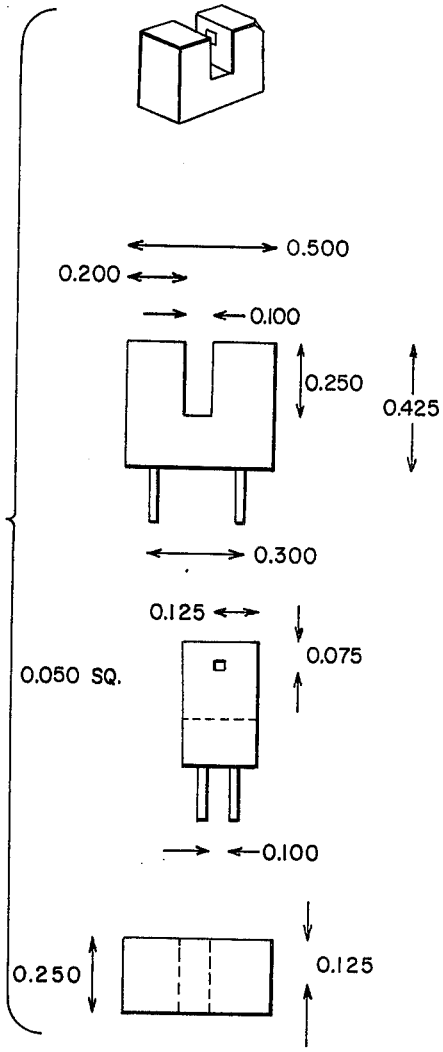

FIG. 1 — Illustrated (for conceptual purposes only) is the size and shape of the package containing the LED and LST. lThis is a commercial unit MCA 81 manufactured by Monsanto.

Figure 2A:
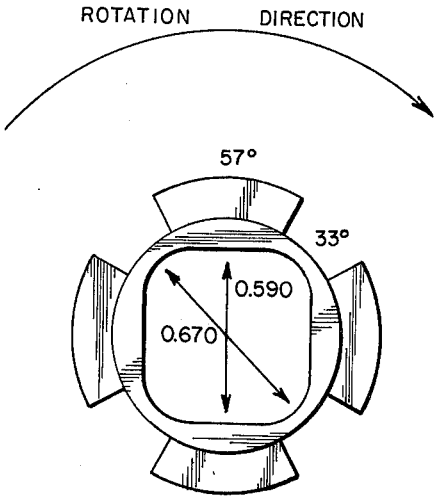
Figure 2B:
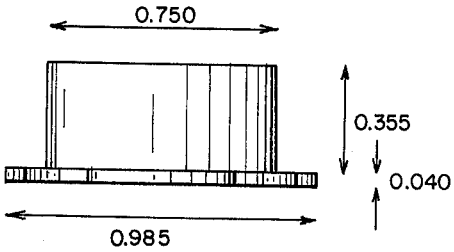

FIGS. 2A–2B — Side and top views of the chopping wheel used by the inventor in a four cylinder, four cycle automobile engine. The relative size of the teeth and gaps provides the necessary dwell for the engine.

FIGS. 3A–3C — The circuits making up part of the device when used with a 12 volt D.C. electrical system. (A) A simple power supply to provide about 45 ma to the Light Emitting Diode (LED). (B) The same simple power supply (to provide +5V D.C. to the integrated circuit (IC)) followed by the pulse shaping circuit. This pulse shaping circuit receives input from the Light Sensitive Transistor (LST) and consists of $C_5$, and two Schmidt triggers contained in the IC. An Electronic Ignition (EI) is driven by transistor $T_3$ receiving input through $C_6$ and $R_4$. $T_3$ is protected against voltage spikes by $Z_3$.

DESCRIPTION

We will speak of a "gasoline engine" as any which is fired by a high voltage discharge from a "coil" through spark plugs and in which the instants of discharge of the high voltage coil circuit (the "timing") and the lengths of time in which the low voltage coil circuit is open or closed (the "dwell") are controlled by mechanical breaker points opened and closed by a cam attached to the motor (normally a part of the "distributor").

In the low voltage coil circuit, normally several amperes flow through the breaker points in their closed condition. To limit this current to a value which can be effectively switched by the present "Electronic Breaker Points" (or device), it is necessary to place in the low voltage coil circuit an "Electronic Ignition (EI)" which can be of either the transistor or thyristor (capacitor discharge) type as long as its control current does not exceed the limits of the device (about 1 ampere maximum in the experimental model). Such Electronic Ignitions are available commercially or through many circuits published in the electronics literature, and we will not concern ourselves further with their nature here.

Such an Electronic Ignition is normally switched by the mechanical breaker points. However, the device described here replaces the mechanical breaker points by an optical circuit, a chopping wheel, and a pulse shaping circuit so that the mechanical breaker points are eliminated and the Electronic Ignition receives its timing and dwell control from the device. The device, in addition, does not wear because it has no moving mechanical parts in contact, it does not change its timing or dwell with use because there is no wearing, and it is able to switch at much higher operation frequencies (high rpm's) where mechanical breaker points begin to float and fail.

The specific description of the device here will pertain to a model designed for and used in the four cylinder, four cycle automobile engine of a Renault 5TL automobile. The Electronic Ignition used along with this device is a commercial model of the thyristor or capacitor discharge type requiring a control current of about 0.35 amperes through the device. However, the device can be used with other makes and models of engines with other numbers of cylinders by suitable modification of the chopping wheel and with other types of electronic ignition systems within the current limitation mentioned above. Modification of the output transistor of the device will also enable it to switch larger currents.

The basis of the device is the optical circuit formed by a Light Emitting Diode (LED) and a Light Sensitive Transistor (LST) mounted with an air gap between them. Through this air gap the chopping wheel passes to make and break the optical circuit. In the experimental device this optical circuit is a modified Slotted Optical Limit Switch model MCA 81 manufactured by Monsanto where the LED and LST are both encapsulated in a small plastic package with the required air gap between them. For visualization of this package, the physical sizes and arrangement are pictured in FIG. 1.

For operation, this LED-LST package is mounted in the distributor, with its optical axis parallel to the axis of cam rotation, in such a manner that it can move with the normal timing advance and retard mechanisms of the distributor. In the experimental model this is accomplished by removing the rubbing block from the normal mechanical breaker points and mounting the LED-LST package in its place in such a manner that the package does not touch the rotating cam. In this case, the mechanical breaker points serve no purpose except as a convenient mechanical mounting platform which moves properly for the timing advance and retard.

With the optical circuit thus in place with its axis parallel to the rotation axis of the distributor cam, a chopping wheel is placed over the cam with its teeth protruding through the air gap in the LED-LST package in such a way that rotation of the cam will cause the teeth of the chopping wheel to alternately block and allow the optical connection betwen the LED and LST. This chopping wheel is rigidly attached to the cam and rotates with it. The length of the teeth is only important to fit within the confines of the distributor, to extend far enough into the air gap of the LED-LST package to break and allow the optical circuit, and to permit free rotation of the chopping wheel without physically touching the LED-LST package or the sides of the distributor. The widths of the teeth and gaps on the chopping wheel are chosen to correspond to the required on and off times needed in the low voltage circuit of the coil (the dwell), and the number of teeth is determined by the type and number of cylinders of the engine being controlled. Since there is no moving mechanical contact between either the chopping wheel and the cam or between the chopping wheel and the LED-LST package, there are no areas of wear. For the experimental device, the chopping wheel is shown in FIG. 2 in both side and top views. For the normal four cylinder, four cycle engine with the distributor cam turning at half of the engine rate, four ignitions are required for each two revolutions of the motor (for each one revolution of the distributor cam) requiring, thus, a four tooth chopping wheel. (As is obvious from this analysis, the distributor cam, itself, must have four lobes for the normal driving of the mechanical contact points and thus, to fit snugly over this cam, the chopping wheel has a roughly square hole in its center.) The chopping wheel is placed over the distributor cam so that its teeth can turn through the air gap of the LED-LST package without physical contact. The chopping wheel is then fastened to the cam with a set screw. To reduce scattered light and reflections, the chopping wheel is painted black. Since this particular motor requires 57° of dwell, the length of each tooth is 57° and each gap is 33°. Rotation of this particular distributor cam is clockwise as seen from above and ignition occurs when a tooth blocks the light circuit.

For the complete device, two further electronic circuits are required: one to "light" the LED which burns continuously, and one to transform the low power, slow rise-time output from the LST to a form useful for switching an Electronic Ignition. The first of these circuits is any sort of power supply which can provide approximately 0.045 amperes to the LED constantly. The one which is used in the experimental device is shown in FIG. 3(A). It is a simple and very conventional one transistor power supply mounted externally to the distributor which provides a regulated +5V D.C. output over a reasonable range of input voltages (the $\approx$ +12V D.C. electrical system of the car here) and a reasonable range of output currents. The dropping resistor $R_2$ was simply chosen to limit the LED current to about 0.045 amperes. The second circuit, here, is specialized and accepts the relatively low power, slow rise-time output of the LST, sharpens its form, increases its power, and gives it the correct phase to drive the input of an Electronic Ignition. The circuit used for the experimental device (FIG. 3(B)) consists, first, of a conventional power supply, exactly like that described above, to supply the proper +5V D.C. for the Integrated Circuit (IC); second, of an IC containing two Schmidt triggers connected in series to receive the switching from the LST, sharpen its form to give precise switching times, and provide it with the proper phase; and third, of a connecting resistor and capacitor ($R_4$ and $C_6$) and an output transistor ($T_3$) with sufficient power capability to control an Electronic Ignition. The Zener diode $Z_3$ only protects $T_3$ from damage due to spurious high voltage pulses in the Electronic Ignition, and the capacitor $C_5$ only reduces high frequency disturbances on the input line from the LST.

I claim:

1. Electronic breaker points for gasoline engines adaptable to conventional distributors comprising:

a radiation source and a radiation detector mounted so that the latter receives the emission from the former through an air gap with both mounted within the confines of the distributor such that the physical position of said radiation source and radiation detector changes with the working of the normal advance and retard mechanisms of the distributor;

a chopping wheel with teeth about its periphery mounted fixedly to the rotor shaft of the distributor such that the teeth pass freely between said radiation source and said radiation detector, the said teeth having width, spacing, and number appropriate to the timing and dwell of the engine being controlled;

a supply circuit to provide a constant current to the radiation source independent of the temperature of said radiation source;

an output transistor to provide switching control to an independent electronic ignition system;

a pulse shaping circuit to receive the output from said radiation detector and provide control to the output transistor;

a supply circuit to provide constant voltage to said pulse shaping circuit independent of the primary automobile supply voltage;

said pulse shaping circuit consisting chiefly of a commercial integrated circuit package containing first and second Schmidt triggers;

a coupling capacitor between the second Schmidt trigger and the output transistor producing a sharp negative pulse at the input of said output transistor to switch said output transistor sharply off which produces an abrupt transition at the collector of said output transistor to switch an electronic ignition system.

2. The system of claim 1 wherein the radiation source and radiation detector are included in a compact comercially available package as an optical limit switch.

3. The system of claim 1 wherein the current supply circuit to the radiation source is mounted externally to the distributor and supplies a constant current to said radiation source independent of the voltage of the primary automobile supply voltage and independent to the temperature of said radiation source.

4. The system of claim 1 wherein the voltage supply circuit to the pulse shaping circuit is mounted externally to the distributor and supplies a constant voltage independent of the primary automobile supply voltage.

5. The system of claim 1 wherein the radiation source and radiation detector package are mounted in place of the rubbing block of the standard contact points of the distributor is such a manner as to not touch the chopping wheel and to move freely with the normal timing advance and retard mechanisms of the distributor.

6. The system of claim 1 wherein the input to the pulse shaping circuit contains a capacitor to attenuate any high frequency interference on the input line.

* * * * *